US010907300B2

(12) United States Patent
Yang et al.

(10) Patent No.: US 10,907,300 B2
(45) Date of Patent: Feb. 2, 2021

(54) PORTABLE STEAMER WITH IRONING ARRANGEMENT

(71) Applicant: Shenzhen Chenbei Technology Co., Ltd., Shenzhen (CN)

(72) Inventors: Lin Yang, Shenzhen (CN); Hai Yang, Shenzhen (CN)

( * ) Notice: Subject to any disclaimer, the term of this patent is extended or adjusted under 35 U.S.C. 154(b) by 216 days.

(21) Appl. No.: 15/842,930

(22) Filed: Dec. 15, 2017

(65) Prior Publication Data

US 2019/0186072 A1 Jun. 20, 2019

(51) Int. Cl.
*D06F 87/00* (2006.01)
*D06F 73/00* (2006.01)

(52) U.S. Cl.
CPC ..... *D06F 87/00* (2013.01); *D06F 73/00* (2013.01)

(58) Field of Classification Search
CPC ..... D06F 87/00; D06F 73/00
See application file for complete search history.

(56) References Cited

U.S. PATENT DOCUMENTS 3,620,055 A * 11/1971 Blachly ..... D06F 75/30 68/222
5,832,639 A * 11/1998 Muncan ..... D06F 75/12 38/77.6
7,516,565 B1 * 4/2009 Tsen ..... A47L 13/22 15/321
2003/0221341 A1 * 12/2003 Sastre ..... D06F 75/14 38/77.1
2010/0058623 A1 * 3/2010 Fernandez ..... D06F 71/18 38/14
2010/0224206 A1 * 9/2010 Serresvives ..... A45D 1/04 132/212
2012/0023789 A1 * 2/2012 Harrington ..... D06F 75/18 38/77.9
2014/0223973 A1 * 8/2014 Alrefaei ..... D06F 73/00 68/5 B
2015/0218746 A1 * 8/2015 Clowes ..... D06F 75/14 8/137
2017/0260685 A1 * 9/2017 Fung ..... D06F 87/00

* cited by examiner

*Primary Examiner* — Benjamin L Osterhout
(74) *Attorney, Agent, or Firm* — Tsz Lung Yeung

(57) ABSTRACT

A portable steamer for use with an external container includes a steamer housing, a steam generator, an ironing arrangement, and engagement arrangement and a pumping device. The ironing arrangement includes an ironing head mounted on the steamer housing. The engagement arrangement is provided on a water inlet of the steamer housing for selectively engaging with the external container. The pumping device is provided in the steamer housing for pumping water from the external container to the steam generator. The steam generator is arranged to deliver steam to a steam outlet of the steamer housing while at the same time the ironing head is arranged to be utilized for flattening fabric.

7 Claims, 7 Drawing Sheets

PORTABLE STEAMER WITH IRONING ARRANGEMENT

BACKGROUND OF THE PRESENT INVENTION

Field of Invention

The present invention relates to a steamer for clothing, and more particularly to a portable steamer comprising an ironing arrangement such that the portable steamer may utilize steam and iron clothing fabric at the same time by using water from an external container.

Description of Related Arts

A conventional clothing steamer usually comprises a main body, a steam generator provided in the main body for generating steam of high-temperature. The steam may then be directed to clothing fabric for removing wrinkles. A common disadvantage of conventional clothing steamers is that they cannot perform ironing to the relevant clothing. Moreover, almost all clothing steamers are equipped with a water tank so that they are generally not very portable. Since they cannot be used as an iron and are not very portable, most people do not carry one when they are traveling.

As a result, there is a need to develop a steamer which may improve upon the above-mentioned conventional clothing steams so that it is portable, easy to use, and may be used as an iron for flattening clothing fabric.

SUMMARY OF THE PRESENT INVENTION

Certain variations of the present invention provide a portable steamer comprising an ironing arrangement such that the portable steamer may utilize steam and iron clothing fabric at the same time by using water from an external container.

Certain variations of the present invention provide a portable steamer which may utilize typical water bottle as a container to store water, so that the portable steamer of the present invention does not need to have a built-in water tank.

In one aspect of the present invention, it provides a portable steamer for use with an external container filled with a predetermined amount of water, comprising:

a steamer housing having a water inlet and a steam outlet;

a steam generator receiving in the steamer housing;

an ironing arrangement which comprises an ironing head mounted on the steamer housing; and an engagement arrangement provided on the water inlet of the steamer housing for selectively engaging with the external container; and a pumping device provided in the steamer housing for pumping water from the external container to the steam generator, wherein the steam generator is arranged to deliver steam to the steam outlet while at the same time the ironing head is arranged to be utilized for flattening fabric.

This summary presented above is provided merely to introduce certain concepts and not to identify any key or essential features of the claimed subject matter.

DETAILED DESCRIPTION OF THE PREFERRED EMBODIMENT

Figure 1:
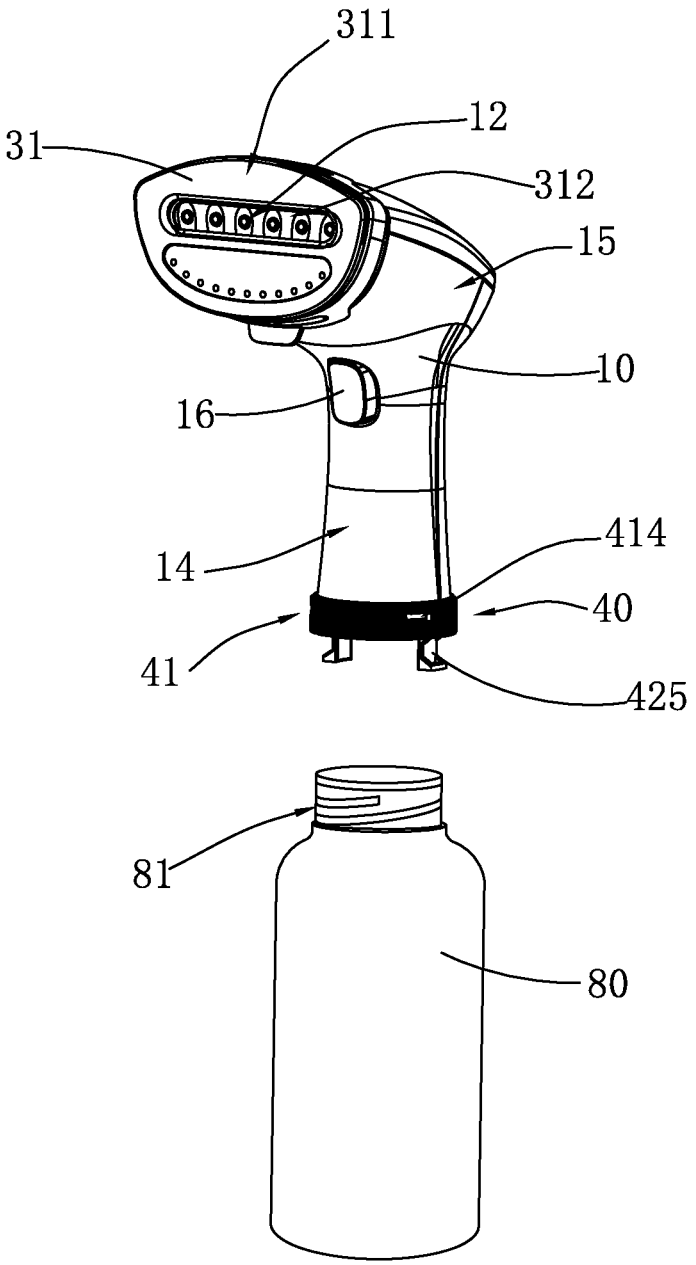
FIG. 1 is a schematic front view of a portable steamer according to a preferred embodiment of the present invention.
Figure 2:
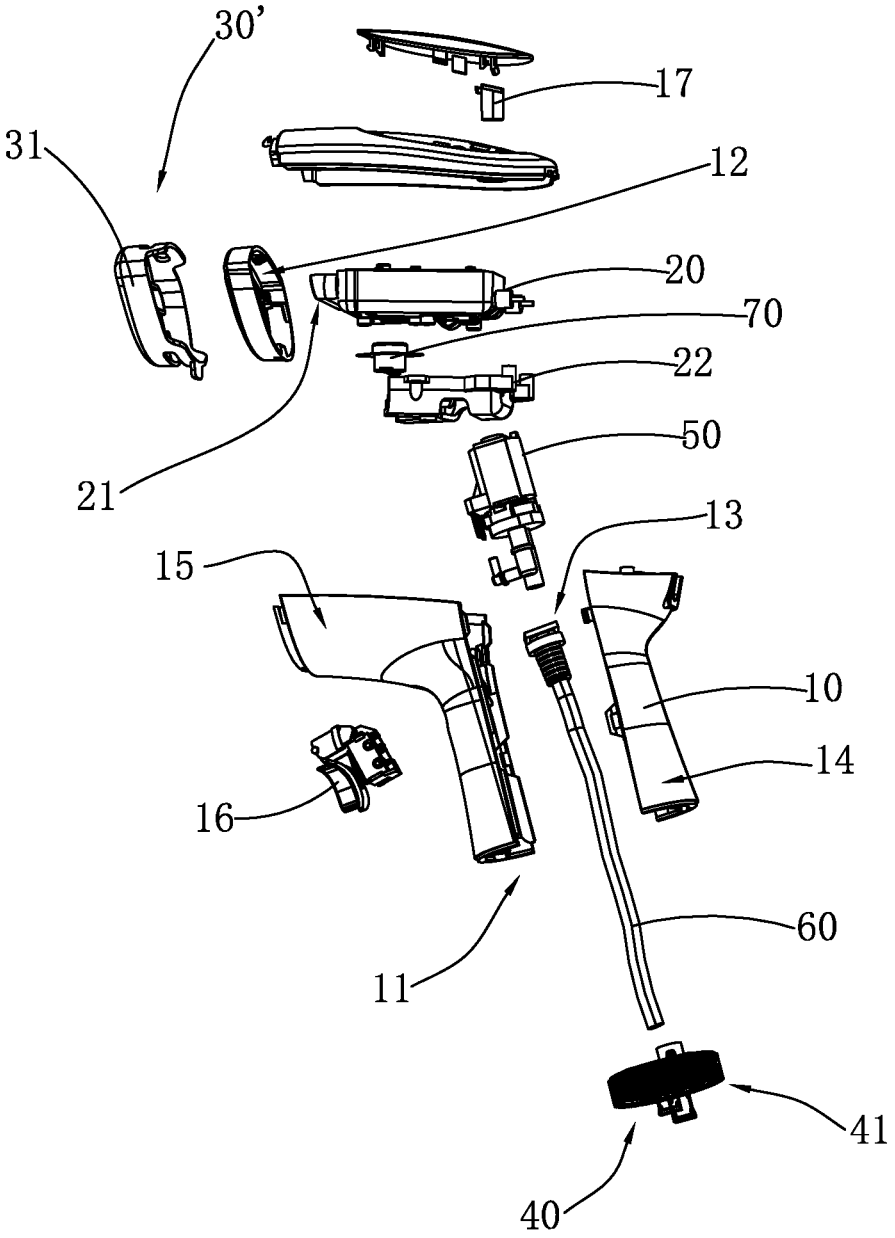
FIG. 2 is an exploded perspective view of the portable steamer according to the preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 3 and FIG. 7 of the drawings, a portable steamer according to a preferred embodiment of the present invention is illustrated. Broadly, the portable steamer may comprise a steamer housing 10, a steam generator 20, an ironing arrangement 30, an engagement arrangement 40, and a pumping device 50. The portable steamer may be for use with an external container 80 filled with a predetermined amount of water. The external container 80 may be a disposable bottle for drinking water.

The steamer housing 10 may have a water inlet 11, a steam outlet 12, and a receiving cavity 13. The steam generator 20 may be received in the steamer housing 10 and mounted in the received cavity 13.

The ironing arrangement 30 may comprise at least a first ironing head 31 mounted on the steamer housing 10. The engagement arrangement 40 may be provided on the water inlet 11 of the steamer housing 10 for selectively engaging with the external container 80.

The pumping device 50 may be provided in the steamer housing 10 for pumping water from the external container 80 to the steam generator 20, wherein the steam generator 20 may be arranged to deliver steam to the steam outlet 12 while at the same time the ironing head 31 may be arranged to be utilized for flattening clothing fabric.

According to the preferred embodiment of the present invention, the steamer housing 10 may have a longitudinal portion 14 and a traverse portion 15 to form a substantially L-shaped cross-sectional shape when viewed from the front or from the rear side of the steamer housing 10. The steam outlet 12 may be provided on a free end of the transverse portion 15 while the water inlet 11 may be provided on a free end of the longitudinal portion 15 of the steamer housing 10. The longitudinal portion 15 of the steamer housing 10 may be configured as a handle for allowing a user to grab thereon.

The steam generator 20 may be mounted in the longitudinal portion 15 of the steamer housing 10 through a supporting frame 22. The steam generator 20 may be configured to heat up water and generate steam toward the steam outlet 12 through a steam output port 21. Thus, the steam output port 21 may be positioned to correspond and align with the steam outlet 12 of the steamer housing 10 so that the steam generated by the steam generator 20 and outputted from the steam output port 21 may be guided to be delivered out of the steamer housing 10 through the steam outlet 12.

The portable steamer may further comprise a temperature sensor 70 provided in the steamer housing 10 and electrically connected to the steam generator 20, such that when the temperature of the steam generator 20 is above a preset threshold, the temperature sensor 70 may cut off electricity supply to the steam generator 20 for safety purpose. The portable steamer may further comprise a rechargeable battery 90 received in the steamer housing 10 and electrically connected to the steam generator 20, the pumping device 50 and the temperature sensor 70 for providing power to these elements. Thus, when the rechargeable battery 90 is fully recharged, a user does not need to acquire external AC power for operating the portable steamer of the present invention. The rechargeable battery 90 may also be electrically connected to an external power source for recharging.

In addition, the steamer housing 10 may further comprise an indicator 17 provided on a top portion thereof for indicating an operation status of the portable steamer. The indicator may be configured as a Light Emitting Diode (LED) or other illuminators.

The ironing head 31 of the ironing arrangement 30 may be mounted on the steamer housing 10 at the steam outlet 12 for flattening a desired clothing fabric. Thus, the ironing head 31 may have a flat surface 311 adapted for ironing the clothing fabric, and a through steam opening 312 formed on the flat surface 311 and communicated with the steam outlet 12 of the steamer housing 10. Accordingly, the ironing head 31 may allow the steam delivered from the steam outlet 12 to pass therethrough. The clothing fabric may then be properly ironed with the help of the steam.

The portable steamer may further comprise a water guiding tube 60 having one end connected to the pumping device 50 and another end extended out of the steamer housing 10 through the engagement arrangement 40. The water guiding tube 60 may be configured as an elongated and flexible tube for transporting water from the external container 80 to the steam generator 20 through the pumping device 50. Note that the water guiding tube 60 may be extended in the longitudinal portion 14 of the receiving cavity 13.

On the other hand, the engagement arrangement 40 may comprise a securing member 41 and an attachment member 42. The securing member 41 may be attached on the steamer housing 10 at the water inlet 11 thereof. The attachment member 42 may be detachably attached on the securing member 41 and may be configured to detachably attach on the external container 80.

Figure 3:
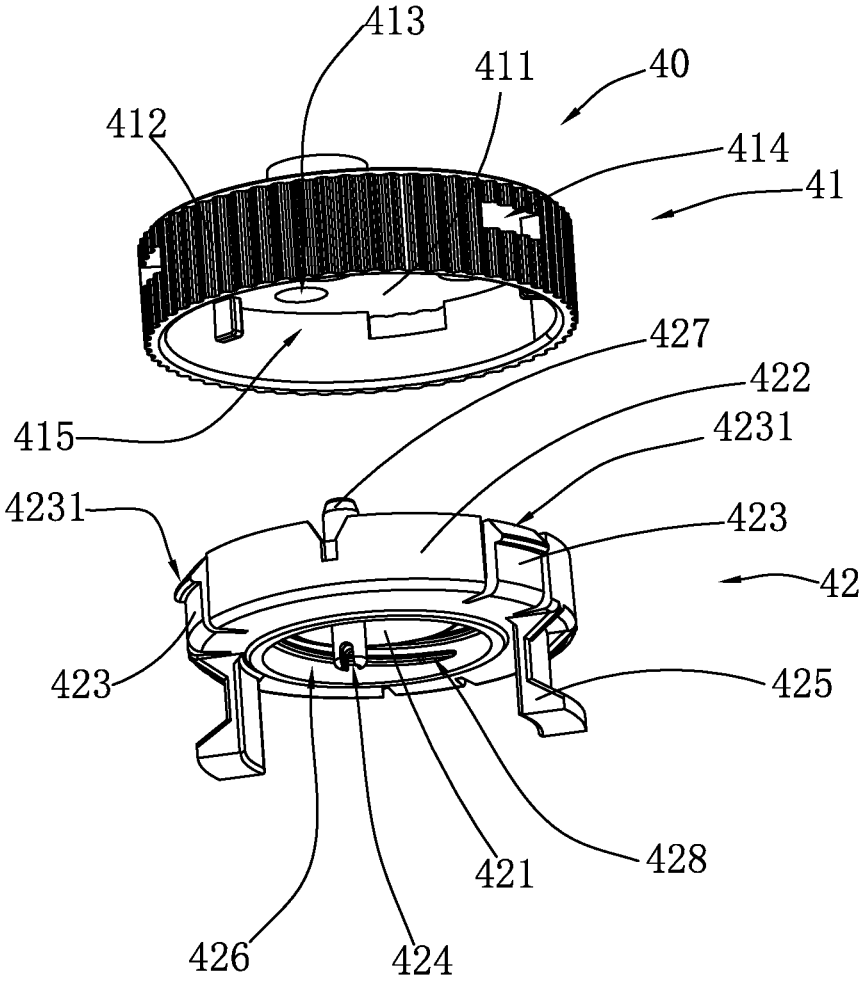
FIG. 3 is a schematic diagram of an engagement arrangement of the portable steamer according to the preferred embodiment of the present invention.

As shown in FIG. 3 of the drawings, the securing member 41 may be configured to have a circular cross-sectional shape when viewed from the top or from the bottom, and may have a securing wall 411 and a circumferential sidewall 412 downwardly extended from the securing wall 411 to form a securing cavity 415 formed as a space surrounded by the securing wall 411 and the circumferential sidewall 412. The securing member 41 may have a through securing hole 413 formed on the securing wall 411 for allowing the water guiding tube 60 to pass through. The securing member 41 may further have a plurality of engagement slots 414 spacedly formed on the circumferential sidewall 412 for detachably engaging with the attachment member 42. An outer surface of the circumferential sidewall 412 may be configured to have an uneven surface (such as a zigzag contour) for aesthetic purpose and for allowing a user to convenient grab on the uneven surface.

The attachment member 42 may also have a substantially circular cross-sectional shape and may comprise a central wall 421 and a circumferential peripheral wall 422 peripherally and downwardly extended from the central wall 421 to form an attachment cavity 426 as the space surrounded by the central wall 421 and the circumferential peripheral wall 422. The attachment member 42 may further comprise a plurality of engagement clips 423 spacedly provided on the circumferential peripheral wall 422 and positioned to correspond to that of the engagement slots 414 of the securing member 41 respectively so that the attachment member 42 may detachably attach on the securing member 41 through the engagement slots 414 and the engagement clips 423.

Specifically, each of the engagement clips 423 may have an engagement protrusion 4231 and may be configured to have a predetermined elasticity in such a manner that when the attachment member 42 is attached on the securing member 41, the engagement clip 423 may normally bias against an inner side of the circumferential sidewall 412 such that the engagement protrusion 4231 may be arranged to pass through the corresponding engagement slot 414 for detachably attaching the attachment member 42 on the securing member 41. Thus, part of the attachment member 42 may be received in the securing cavity 415 of the securing member 41 when the attachment member 42 is attached on the securing member 41. Accordingly, an external diameter of the attachment member 42 may be slightly less than an internal diameter of the securing cavity 415 of the securing member 41.

The attachment member 42 may further comprise an elongated attachment holder 427 extended on the central wall 421, wherein the elongated attachment holder 427 may have a cylindrical structure and may have a through attachment hole 424 formed at a position corresponding to the through securing hole 413 of the securing member 41, so that the water guiding tube 60 may be arranged to pass through the through securing hole 413 and the through attachment hole 424 for reaching the external container 80. The position of the water guiding tube 60 may be retained by the elongated attachment holder 427. Water stored in the external container 80 may be pumped to the steam generator 20 through the water guiding tube 60.

As shown in FIG. 3 of the drawings, the attachment member 42 may further comprise a plurality of attachment legs 425 downwardly extended from the circumferential peripheral wall 422 for selectively engaging with an appropriate external container 80. Moreover, an inner surface of the circumferential peripheral wall 422 may be threaded so that the threaded portion 428 may engage with the external container 80, which may have an externally threaded neck portion 81.

The operation of the present invention is as follows: the portable steamer of the present invention may be utilized in conjunction with a typical water bottle, such as a regular plastic bottle for drinking water as the external container 80. The external container 80 may thus has an externally threaded neck portion for engaging with a cap. However, this threaded portion may be used to engage with the threaded portion 428 of the attachment member 42. The external container 80 may be filled with water. The external container 80 may be engaged with the attachment member 42 and the water guiding tube 60 may be arranged to be inserted into the external container 80 for retrieving water.

When a user wishes to iron or steam his clothing fabric, he may turn on the portable steamer through a switch 16 provided on the steamer housing 10. The pumping device 50 of the portable steamer may pump water from the external container 80 to the steam generator 20 and deliver the steam through the steam output port 21. After that, the user may iron the fabric clothing by the first ironing head 31.

Figure 4:
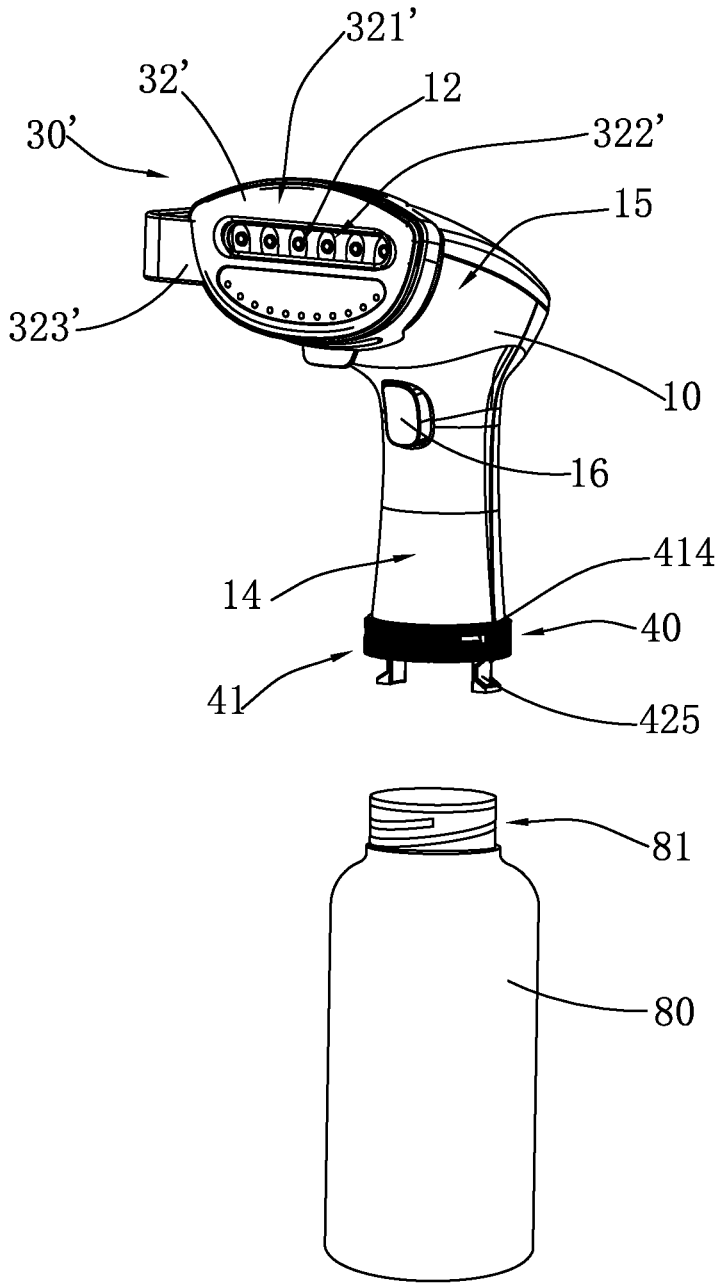
FIG. 4 is an alternative mode of the portable steamer according to the preferred embodiment of the present invention.
Figure 5:
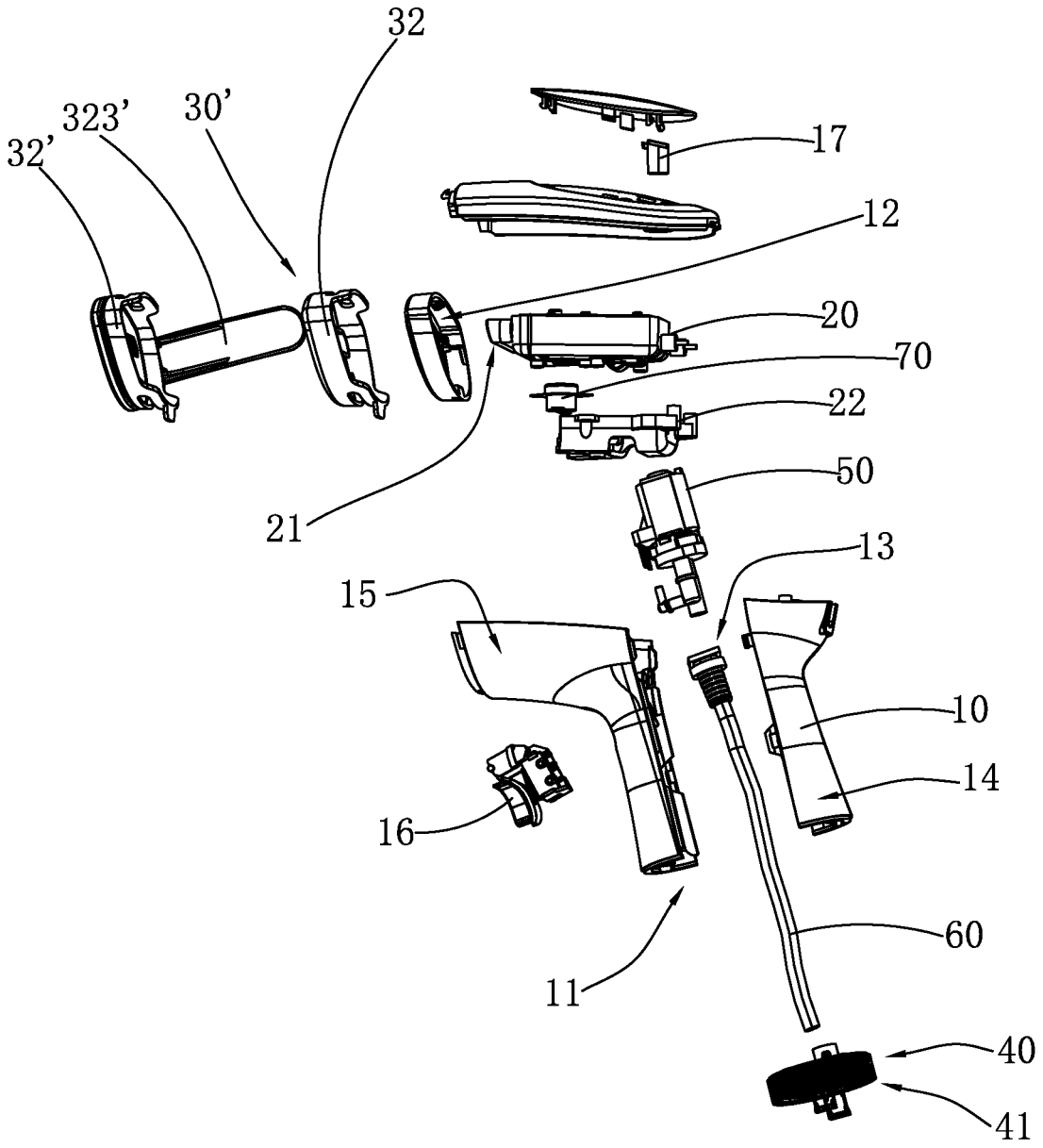
FIG. 5 is an exploded perspective view of the portable steamer according to the alternative mode of the preferred embodiment of the present invention.
Figure 6:
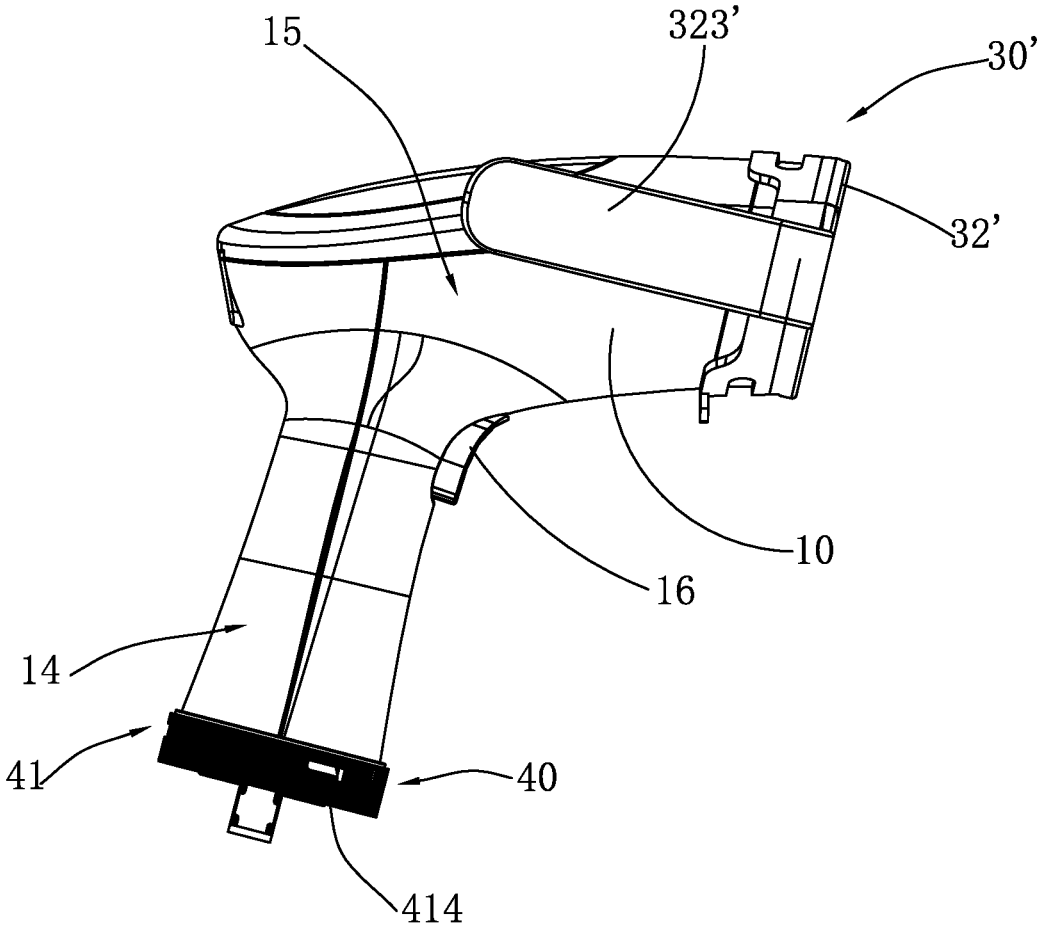
FIG. 6 is a schematic side view of the portable steamer according to the alternative mode of the preferred embodiment of the present invention.
Figure 7:
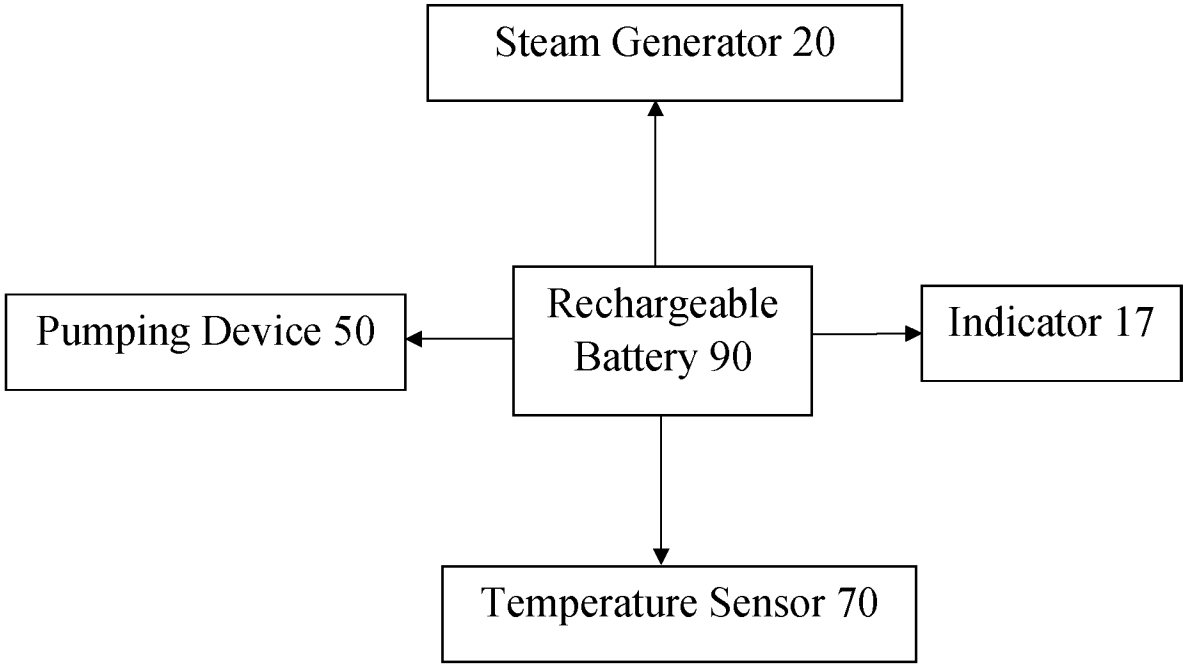
FIG. 7 is a block diagram of the portable steamer according to the preferred embodiment of the present invention.

Referring to FIG. 4 to FIG. 6 of the drawings, an alternative mode of the portable steamer according to the preferred embodiment of the present invention is illustrated. The alternative mode is similar to the preferred embodiment, except the ironing arrangement 30'. According to the alternative mode, the ironing arrangement 30' may further comprise an auxiliary ironing head 32' detachably mounted on the steamer housing to substantially cover the ironing head 31. The auxiliary ironing head 32' may be detachably attached on the steamer housing 10 so that a user may be able to select which ironing head 31, 32' is to be used.

The auxiliary ironing head 32' may have an elongated holding clip 323' rearwardly extended from an auxiliary flat surface 321' for clipping on a user's clothing, such as a pant. The user may then use the auxiliary ironing head 32' to iron and steam his pant.

On the other hand, when the auxiliary ironing head 32' is not needed, the user may detach the auxiliary ironing head 32' and use only the ironing head 31. The ironing head 31 and the auxiliary ironing head 32' may be structurally identical except that the auxiliary ironing head 32' has the elongated holding clip 323'. Thus, the auxiliary ironing head 32' may also have a through auxiliary steam opening 322' and an auxiliary flat surface 321'. The auxiliary flat surface 321' may also be adapted for ironing the clothing fabric.

The through auxiliary steam opening 322' may be formed on the auxiliary flat surface 321' and may communicate with the through steam opening 311 of the ironing head 31 and the steam outlet 12 of the steamer housing 10. Accordingly, when the ironing head 31 and the auxiliary ironing head 32' are both attached on the steamer housing 10, the steam delivered from the steam outlet 12 may pass through the steam opening 311 and the auxiliary steam opening 322'. The clothing fabric may then be properly ironed with the help of the steam.

The advantage of the present invention is that the user does not need to carry any container with him. He may use a typical water bottle (such as a disposable water bottle) as the external container 80 and fill that water bottle with a predetermined amount of water before use. As such, the portable steamer of the present invention can be configured as extremely portable and can resolve the problems associated with conventional clothing steamers.

The present invention, while illustrated and described in terms of a preferred embodiment and several alternatives, is not limited to the particular description contained in this specification. Additional alternative or equivalent components could also be used to practice the present invention.

What is claimed is:

1. A portable steamer for use with an external container filled with a predetermined amount of water, comprising:

a steamer housing having a water inlet and a steam outlet and without having a built-in water tank;

a steam generator receiving in said steamer housing;

an ironing arrangement which comprises an ironing head mounted on said steamer housing at said steam outlet for flattening a desired clothing fabric, said ironing head having a flat surface adapted for ironing said clothing fabric, and a through steam opening formed on said flat surface and communicated with said steam outlet of said steamer housing;

an engagement arrangement provided on said water inlet of said steamer housing for selectively engaging with said external container, said engagement arrangement comprising a securing member and an attachment member, said securing member being attached on said steamer housing at said water inlet thereof, said attachment member being detachably attached on said securing member and configured to detachably attach on said external container;

a pumping device provided in said steamer housing for pumping water from said external container to said steam generator, wherein said steam generator is arranged to deliver steam to said steam outlet while at the same time said ironing head is arranged to be utilized for flattening fabric; and a water guiding tube having one end connected to said pumping device and another end extended out of said steamer housing through said engagement arrangement for transporting water from said external container to said steam generator, wherein said securing member has a securing wall and a circumferential sidewall downwardly extended from said securing wall to form a securing cavity formed as a space surrounded by said securing wall and said circumferential sidewall, said securing member further having a through securing hole formed on said securing wall for allowing said water guiding tube to pass through.

2. The portable steamer, as recited in claim 1, wherein said securing member further has a plurality of engagement slots spacedly formed on said circumferential sidewall, said attachment member comprising a plurality of engagement clips positioned to correspond to that of said engagement slots of said securing member respectively so that said attachment member is arranged to be detachably attached on said securing member through detachably engagement of said engagement slots and said engagement clips.

3. The portable steamer, as recited in claim 2, wherein said attachment member comprises a central wall and a circumferential peripheral wall peripherally and downwardly extended from said central wall to form an attachment cavity as a space surrounded by said central wall and said circumferential peripheral wall, said engagement clips extending from said circumferential peripheral wall.

4. The portable steamer, as recited in claim 3, wherein each of said engagement clips has an engagement protrusion and is configured to have a predetermined elasticity in such a manner that when said attachment member is attached on said securing member, said engagement clip is arranged to normally bias against an inner side of said circumferential sidewall and said engagement protrusion is arranged to pass through said corresponding engagement slot for detachably attaching said attachment member on said securing member.

5. The portable steamer, as recited in claim 4, wherein said attachment member further comprises an elongated attachment holder extended on said central wall, said elongated attachment holder having a cylindrical structure and a through attachment hole formed at a position corresponding to said through securing hole of said securing member, said water guiding tube being arranged to pass through said through securing hole and said through attachment hole for reaching said external container.

6. The portable steamer, as recited in claim 5, wherein said attachment member further comprises a plurality of attachment legs downwardly extended from said circumferential peripheral wall for selectively engaging with said external container.

7. The portable steamer, as recited in claim 6, wherein an inner surface of said circumferential peripheral wall is threaded for detachably engaging with said external container.

* * * * *